US008096828B2

(12) United States Patent
Ellis et al.

(10) Patent No.: US 8,096,828 B2
(45) Date of Patent: Jan. 17, 2012

(54) ELECTRICAL CONNECTOR FOR TERMINATING A COAXIAL CABLE

(75) Inventors: Kenneth William Ellis, Etters, PA (US); Robert Neil Mulfinger, York Haven, PA (US); Edmund Luther Jacobs, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/145,167

(22) Filed: Jun. 24, 2008

(65) Prior Publication Data

US 2009/0318019 A1 Dec. 24, 2009

(51) Int. Cl.
*H01R 9/05* (2006.01)

(52) U.S. Cl. ..... 439/578

(58) Field of Classification Search ..... 439/578, 439/669, 79, 668, 63, 934, 585, 388
See application file for complete search history.

(56) References Cited

U.S. PATENT DOCUMENTS

| | | | | |
|---|---|---|---|---|
| 4,897,040 | A * | 1/1990 | Gerke et al. | 439/401 |
| 5,052,944 | A * | 10/1991 | Mitani et al. | 439/394 |
| 5,110,308 | A * | 5/1992 | Nishikawa et al. | 439/582 |
| 5,257,945 | A * | 11/1993 | Heng et al. | 439/406 |
| 6,074,217 | A | 6/2000 | Maruyama et al. | |
| 6,790,082 | B2 | 9/2004 | Obayashi | |
| 7,021,966 | B2 | 4/2006 | Ikeda et al. | |
| 7,367,840 | B2 * | 5/2008 | Chen et al. | 439/581 |

FOREIGN PATENT DOCUMENTS

JP 05-217638 * 8/1993

* cited by examiner

*Primary Examiner* — Tulsidas C Patel
*Assistant Examiner* — Phuong Nguyen

(57) ABSTRACT

An electrical connector is provided for terminating a coaxial cable. The electrical connector includes an electrically conductive housing extending a length between a cable-receiving end portion configured to engage an insulating cover of the coaxial cable and a mating end portion configured to engage another electrical connector. The housing includes an outer electrical contact. An insulating member is held by the housing. An inner electrical contact is held by the insulating member. The inner electrical contact includes a slot configured to receive an inner electrical conductor of the coaxial cable.

18 Claims, 10 Drawing Sheets

ELECTRICAL CONNECTOR FOR TERMINATING A COAXIAL CABLE

BACKGROUND OF THE INVENTION

The subject matter described and/or illustrated herein relates generally to electrical connectors, and more particularly, to electrical connectors for terminating coaxial cables.

Due to their favorable electrical characteristics, coaxial cables and connectors have grown in popularity for interconnecting electronic devices and peripheral systems. Coaxial cable connectors typically include an inner electrical contact coaxially disposed within an outer electrical contact of an electrically conductive housing, with a dielectric material separating the inner electrical contact and the outer electrical contact. The inner electrical contact terminates the end of an inner electrical conductor of the coaxial cable, while the electrically conductive housing terminates an outer electrical conductor of the coaxial cable that is coaxial with the inner electrical conductor. The outer electrical conductor of the coaxial cable and the electrically conductive housing of the coaxial cable connector typically serve as the ground path.

At least some known electrical contacts of coaxial cable connectors that terminate the end of the inner electrical conductor of coaxial cables include a body that extends between a cable-receiving end portion that receives the inner electrical conductor and a contact end portion that includes a plug or receptacle contact portion configured to engage a receptacle or plug contact portion, respectively, of another coaxial cable connector. The body includes a pair of contact elements that extend outwardly from the contact end portion of the body and have free end portions that define the cable-receiving end portion of the body. The contact elements are angled with respect to one another prior to engagement with the inner electrical conductor of the coaxial cable. To terminate the inner electrical conductor of the coaxial cable to the electrical contact, the inner electrical conductor is positioned between the pair of contact elements and the contact elements are brought together using a crimping operation such that the inner electrical conductor is held securely therebetween. However, the geometry of at least some known electrical contacts of coaxial cable connectors, such as, but not limited to, the exemplary geometry described above, may require specific tools and/or multiple crimping operations to complete termination of the inner electrical conductor of the coaxial cable to the electrical contact of the coaxial cable connector.

There is a need for a coaxial cable connector that enables a coaxial cable to be more easily terminated to the coaxial cable connector.

BRIEF DESCRIPTION OF THE INVENTION

In one embodiment, an electrical connector is provided for terminating a coaxial cable. The electrical connector includes an electrically conductive housing extending a length between a cable-receiving end portion configured to engage an insulating cover of the coaxial cable and a mating end portion configured to engage another electrical connector. The housing includes an outer electrical contact. An insulating member is held by the housing. An inner electrical contact is held by the insulating member. The inner electrical contact includes a slot configured to receive an inner electrical conductor of the coaxial cable.

In another embodiment, an electrical connector is provided. The electrical connector includes an insulating member configured to be held by an electrically conductive housing of the electrical connector, and an inner electrical contact configured to be held by the insulating member. The inner electrical contact includes a slot configured to receive an inner electrical conductor of a coaxial cable.

DETAILED DESCRIPTION OF THE INVENTION

Figure 1:
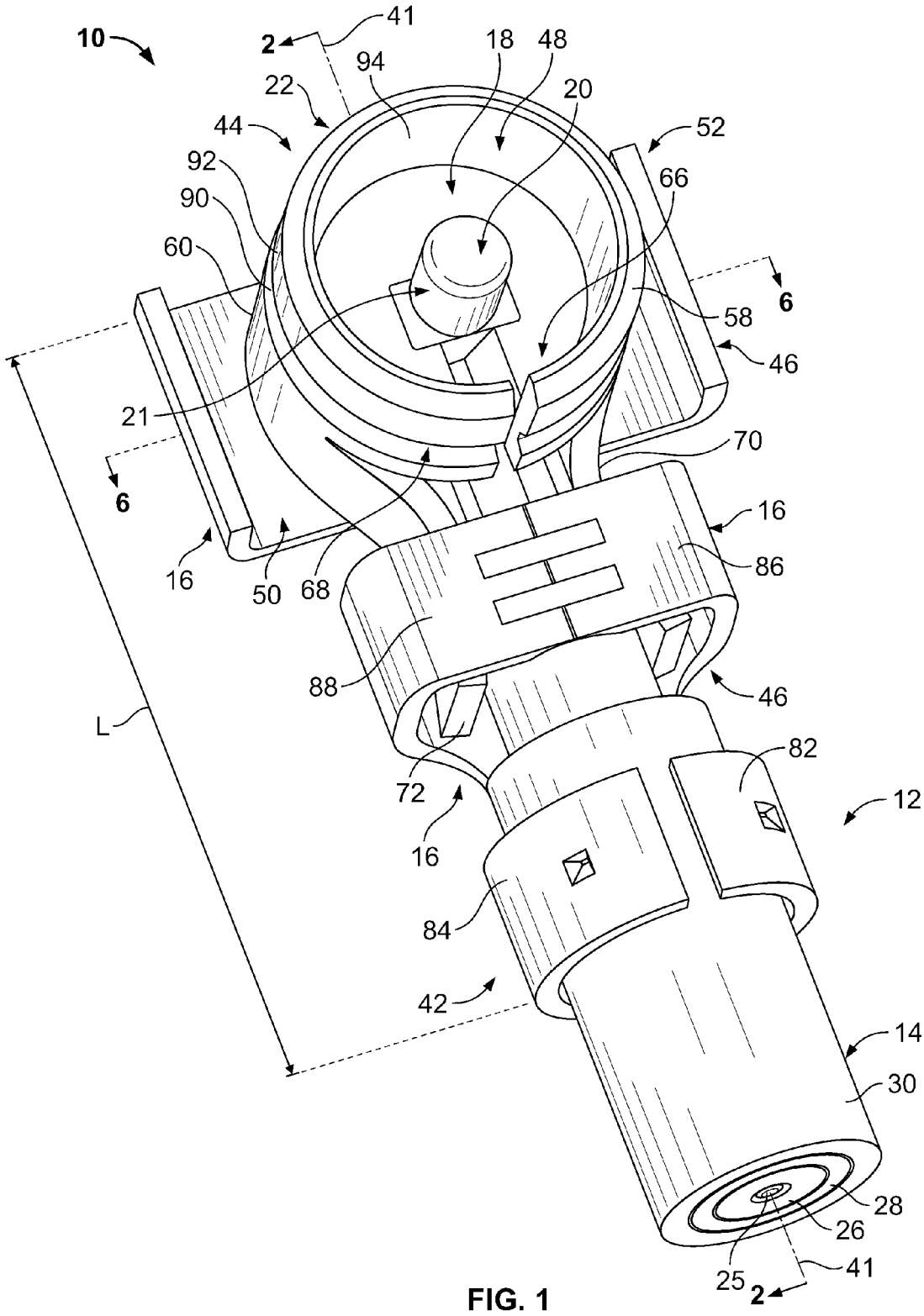
FIG. 1 is a perspective view of an exemplary embodiment of an electrical connector illustrating the electrical connector terminating the end of a coaxial cable.
Figure 2:
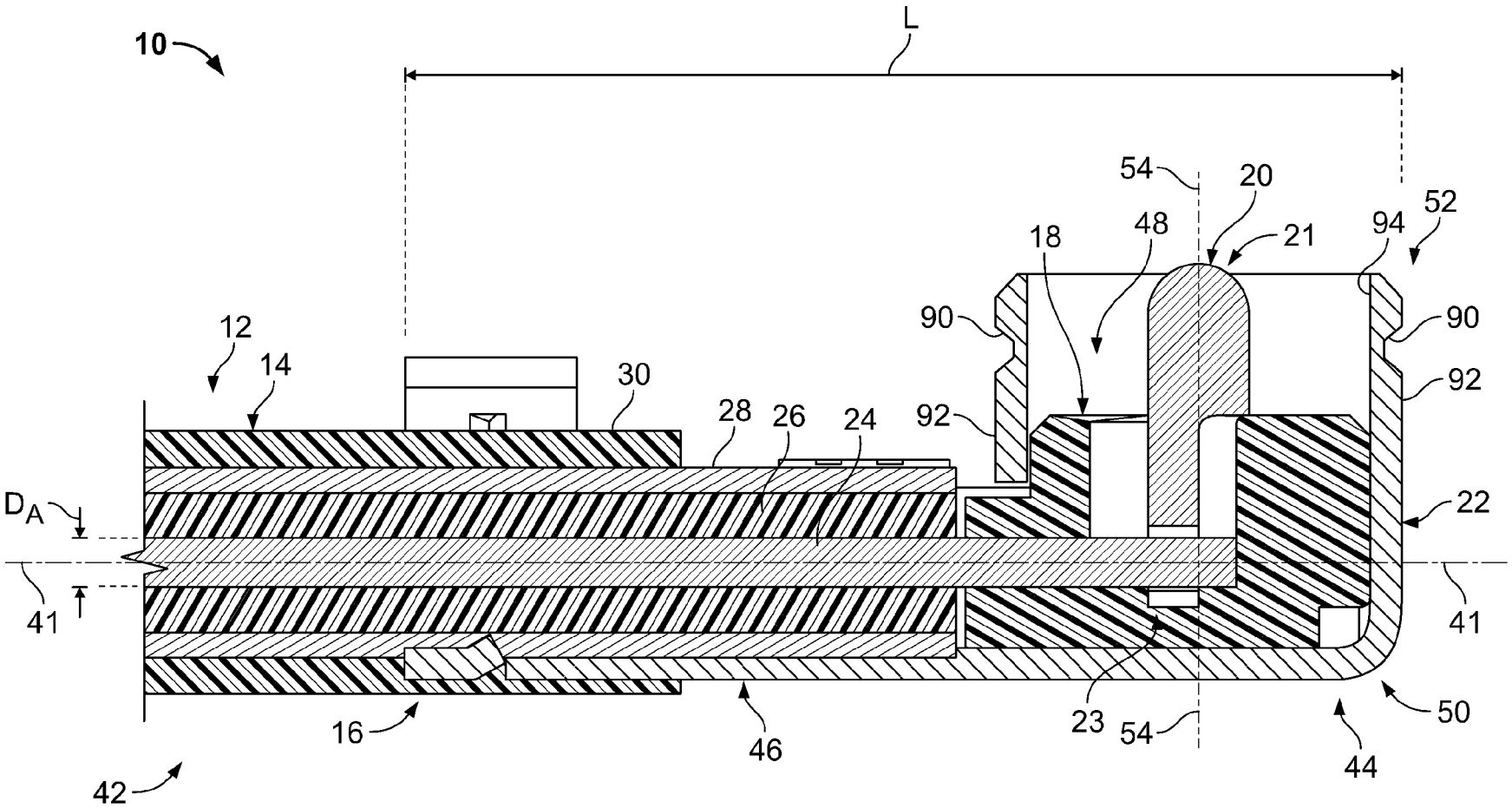
FIG. 2 is a cross-sectional view of the electrical connector and coaxial cable shown in FIG. 1 taken along line 2-2 of FIG. 1.

FIG. 1 is a perspective view of an exemplary embodiment of an electrical connector 10 illustrating the electrical connector 10 terminating the end 12 of a coaxial cable 14. FIG. 2 is a cross-sectional view of the electrical connector 10 and coaxial cable 14 taken along line 2-2 of FIG. 1. The electrical connector 10 includes an electrically conductive housing 16, an insulating member 18 held by the housing 16, and an inner electrical contact 20 held by the insulating member 18. In the exemplary embodiment, the inner electrical contact 20 is a plug contact, which is sometimes referred to as a "pin contact". The housing 16 includes an outer electrical contact 22 that holds the insulating member 18. The outer electrical contact 22 is coaxial with the inner electrical contact 20 and is positioned radially outward from the inner electrical contact 20. The insulating member 18 electrically isolates the inner electrical contact 20 from the outer electrical contact 22 as well as other portions of the housing 16. In the exemplary embodiment, the housing 16 is a ground path, while the inner electrical contact 20 is a signal path. Alternatively, the housing 16 is a signal path and the inner electrical contact 20 is a ground path. The electrical connector 10 may be any type of connector suitable for use with any type of coaxial cable; such connectors are sometimes referred to as "coaxial cable connectors". In the exemplary embodiment, the electrical connector 10 is an ultra miniature coax connector (UMCC).

The coaxial cable 14 includes an inner electrical conductor 24, an insulating member 26 surrounding the inner electrical conductor 24, an outer electrical conductor 28 surrounding the insulating member 26, and an insulating cover 30 surrounding the outer electrical conductor 28. The inner electrical conductor 24, the insulating member 26, the outer electrical conductor 28, and the insulating cover 30 are coaxial, with the insulating member 26 positioned radially outward from the inner electrical conductor 24, the outer electrical conductor 28 positioned radially outward from the insulating member 26, and the insulating cover 30 positioned radially outward from the outer electrical conductor 28. In the exemplary embodiment, the inner electrical conductor 24 is a signal path while the outer electrical conductor 28 is a ground path. However, alternatively the inner electrical conductor 24 may be a ground path while the outer electrical conductor is a signal path.

The inner electrical contact 20 extends between a plug contact end portion 21 and a conductor-receiving end portion 23. The plug contact end portion 21 may be referred to herein as a "contact end portion". As will be described in more detail below, the conductor-receiving end portion 23 is engaged with, and thereby electrically connected to, the inner electrical conductor 24 of the coaxial cable 14. The plug contact end portion 21 of the inner electrical contact 20 is configured to be received by a receptacle contact (not shown) of another electrical connector (not shown) that is configured to mate with the electrical connector 10. Similarly, the outer electrical contact 22 is configured to engage an outer electrical contact (not shown) of the other electrical connector. In some embodiments, the other electrical connector is mounted on a substrate, such as, but not limited to, a circuit board, a panel, and/or the like. In other embodiments, the other electrical connector terminates the end of another coaxial cable (not shown). As will be described in more detail below, the outer electrical contact 22 is electrically connected to the outer electrical conductor 28 of the coaxial cable 14 via engagement between the outer electrical conductor 28 and the housing 16.

The housing 16 extends a length L along a central longitudinal axis 41 between a cable-receiving end portion 42 and a mating end portion 44. The cable-receiving end portion 42 engages the insulating cover 30 of the coaxial cable 14. The mating end portion 44 is configured to engage the other electrical connector. In the exemplary embodiment, the outer electrical contact 22 is located at the mating end portion 44 of the housing 16. The housing 16 includes a base 46 that extends the length L along the central longitudinal axis 41 between the cable-receiving end portion 42 and the mating end portion 44. The outer electrical contact 22 defines a receptacle 48 and extends between a pair of opposite end portions 50 and 52 along a central longitudinal axis 54. In the exemplary embodiment, the outer electrical contact 22 is defined by a pair of walls 58 and 60. The walls 58 and 60 include respective end portions 66 and 68 that oppose one another. Alternatively, the receptacle 48 may be defined by only one wall (not shown). Moreover, the receptacle 48 may alternatively be defined by a continuous wall (not shown). When the housing 16 is assembled as shown in FIGS. 1 and 2, the base 46, at the mating end portion 44, covers, or closes, the end portion 50 (which is initially open) of the outer electrical contact 22.

At the end 12 of the coaxial cable 14, the outer electrical conductor 28 is exposed from the insulating cover 30 and the inner electrical conductor 24 is exposed from the insulating member 26 and the outer electrical conductor 28. A pair of extensions 70 and 72 extends outwardly from the outer electrical contact 22. When the housing 16 is assembled as shown in FIG. 1, the extensions 70 and 72 extend along the base 46 generally toward the cable-receiving end portion 42 of the housing 16. Although one extension 70 and one extension 72 are shown, the outer electrical contact 22 may include any number of extensions 70 and/or 72 extending therefrom. In the exemplary embodiment, the extensions 70 and 72 each engage the exposed portion of the outer electrical conductor 28 of the coaxial cable 14. The engagement between the extensions 70 and 72 and the outer electrical conductor 28 electrically connects the outer electrical conductor 28 of the coaxial cable 14 to the housing 16 and thereby the outer electrical contact 22. The exposed portion of the outer electrical conductor 28 also engages the base 46 of the housing 16 to electrically connect the outer electrical conductor 28 of the coaxial cable 14 to the housing 16 and thereby the outer electrical contact 22.

The housing 16 includes a pair of opposite cover tabs 82 and 84 and a pair of opposite retention tabs 86 and 88. When the electrical connector 10 is assembled as shown in FIG. 1, the coaxial cable end 12 engages the base 46 of the housing 16 and the cover tabs 82 and 84 are wrapped around a portion of the insulating cover 30 and crimped such that inner surfaces of the cover tabs 82 and 84 engage the insulating cover 30 to facilitate securing the coaxial cable 14 to the electrical connector 10. Alternatively, the base 46 may include only one cover tab (not shown). Moreover, the base 46 may alternatively include a continuous cover tab that extends completely around the insulating cover 30. Although one cover tab 82 and one cover tab 84 are shown, the base 46 may include any number of cover tabs 82 and/or 84 extending therefrom.

When the electrical connector 10 is assembled as shown in FIG. 1, the retention tabs 86 and 88 of the base 46 are wrapped around a portion of the extensions 70 and 72, respectively, and crimped such that inner surfaces of the retention tabs 86 and 88 engage the extensions 70 and 72, respectively, to hold the extensions 70 and 72 between a portion of the retention tabs 86 and 88, respectively, and a portion of the base 46. The retention tabs 86 and 88 facilitate retaining the outer electrical contact 22 in the position with respect to the base 46 that is shown in FIGS. 1 and 2. In the exemplary embodiment, the inner surfaces of the retention tabs 86 and 88 engage the exposed portion of the outer electrical conductor 28 of the coaxial cable 14. Engagement between the retention tabs 86 and 88 and the outer electrical conductor 28 electrically connects the outer electrical conductor 28 of the coaxial cable 14 to the housing 16 and thereby the outer electrical contact 22. Alternatively, the base 46 may include only one retention tab (not shown) Although one retention tab 86 and one retention tab 88 are shown, the base 46 may include any number of retention tabs 86 and/or 88 extending therefrom.

Although in the exemplary embodiment the extensions 70 and 72 and the retention tabs 86 and 88 engage the outer electrical conductor 28 of the coaxial cable 14, alternatively the extensions 70 and 72 and/or the retention tabs 86 and 88 do not engage the outer electrical conductor 28. In such an alternative embodiment wherein the extensions 70 and 72 and/or the retention tabs 86 and 88 do not engage the outer electrical conductor 28, the housing 16 may include one or more ground tabs (not shown) that is located along the length L of the housing 16 between the retention tabs 86 and 88 and the cover tabs 82 and 84 and that engages the exposed portion of the outer electrical conductor 28.

The outer electrical contact 22 of the housing 16 may optionally include a groove 90 extending within a radially outer surface 92 of the outer electrical contact 22 that cooperates with an extension (not shown) of another electrical connector that is configured to mate with the electrical connector 10. Cooperation between the groove 90 and the extension creates a snap-fit connection that may facilitate holding the two electrical connectors together. Additionally or alternatively, the outer electrical contact 22 of the housing 16 may optionally include an extension (not shown) extending outwardly from the radially outer surface 92 that cooperates with a groove (not shown) of another electrical connector that is configured to mate with the electrical connector 10. Moreover, the outer electrical contact 22 of the housing 16 may alternatively include a groove (not shown) or an extension (not shown) extending on a radially inner surface 94 of the outer electrical contact 22 that cooperates with a respective extension or groove of another electrical connector that is configured to mate with the electrical connector 10.

Figure 3:
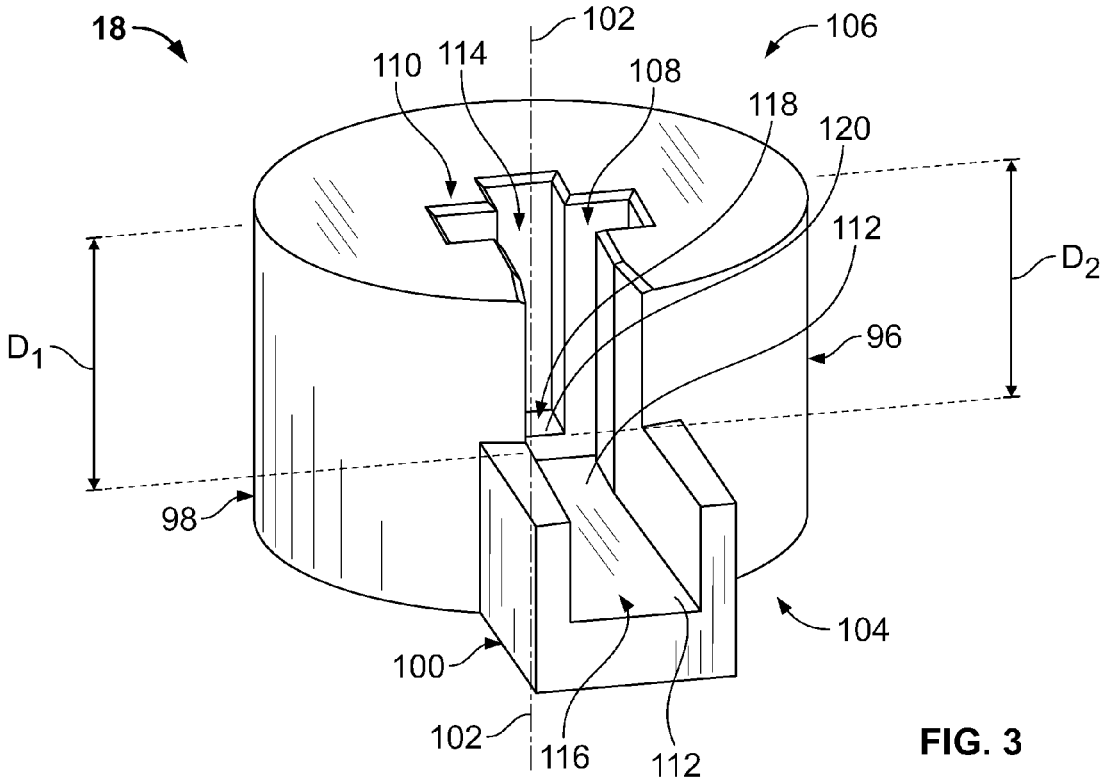
FIG. 3 is a perspective view of an exemplary embodiment of an insulating member of the electrical connector shown in FIGS. 1 and 2.
Figure 4:
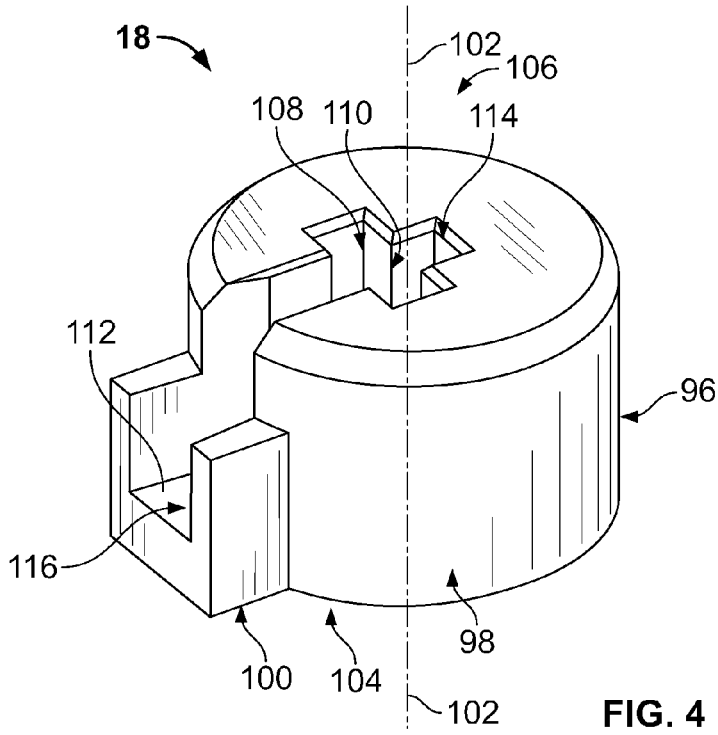
FIG. 4 is another perspective view of the insulating member shown in FIG. 3.
Figure 6:
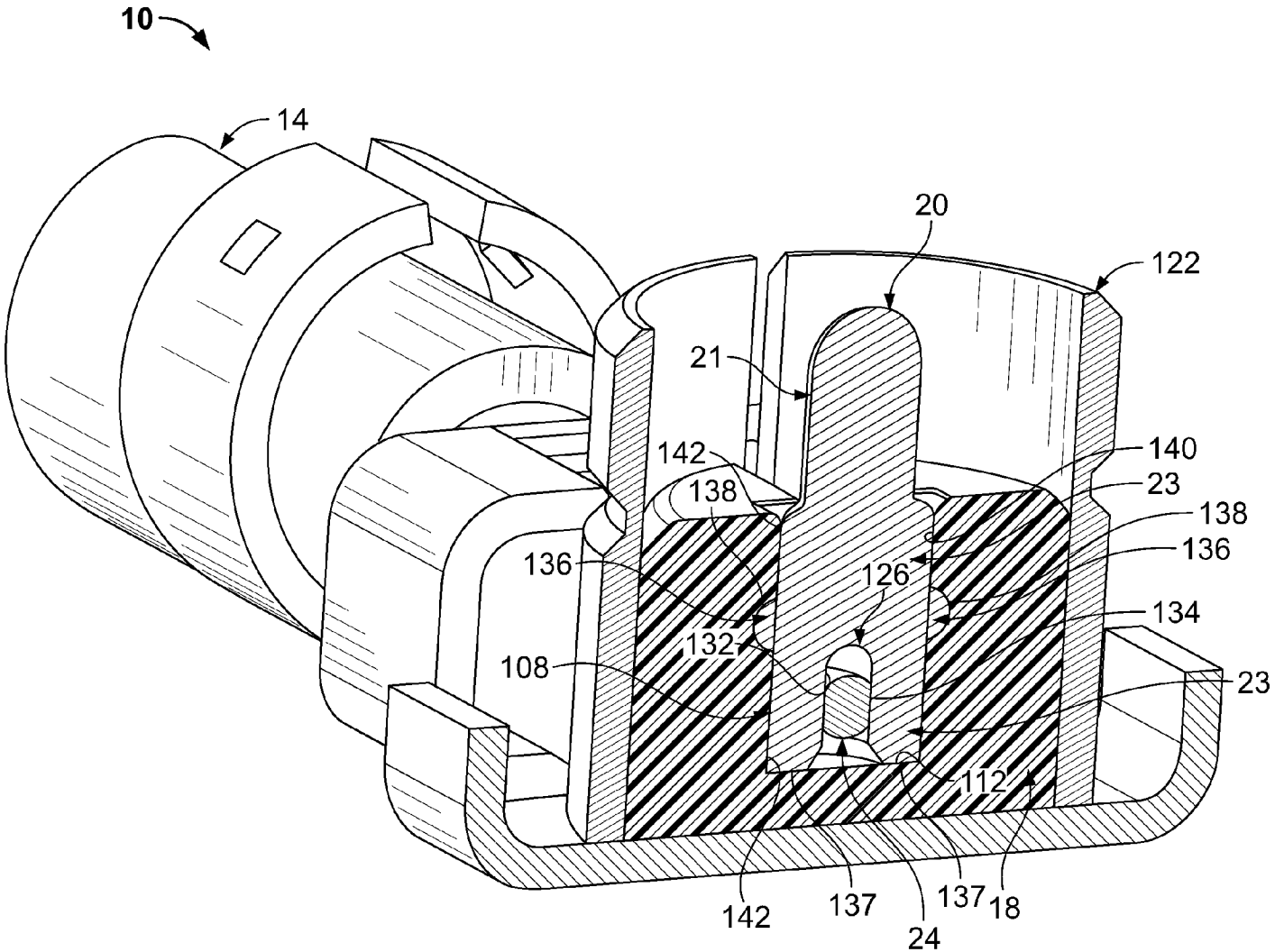
FIG. 6 is a perspective view of the electrical connector and coaxial cable shown in FIGS. 1 and 2 illustrating a cross section of the electrical connector and the coaxial cable taken along line 6-6 of FIG. 1.

FIGS. 3 and 4 are perspective views of an exemplary embodiment of the insulating member 18 of the electrical connector 10 (FIGS. 1, 2, and 6). The insulating member 18 includes a body 96 having an exterior side 98 and an extension 100 extending outwardly from the exterior side 98. The body 96 extends along a longitudinal axis 102 between a pair of opposite end portions 104 and 106. An opening 108 extends within the body 96 between an open end 110 at the end portion 106 of the body 96 and a bottom surface 112. The opening 108 extends from an end portion 114 through the exterior side 98 and the extension 100 to an open end 116. A ledge 118 is formed within the body 96 at the end portion 114 of the opening 108. The bottom surface 112 extends a depth $DEP_1$ from the open end 110 and the ledge 118 extends a depth $DEP_2$ from the open end 110. The depth $DEP_2$ is smaller than the depth $DEP_1$ such that a surface 120 of the ledge 118 is shallower relative to the open end 110 than the bottom surface 112. As described below, the surface 120 of the ledge 118 holds an end portion of the inner electrical conductor 24 of the coaxial cable 14 thereon.

As will be described in more detail below, the conductor-receiving end portion 23 (FIGS. 2 and 5-9) of the inner electrical contact 20 (FIGS. 1, 2, and 5-9) is held within the opening 108 such that the plug contact end portion 21 is configured to be received by the receptacle contact of another electrical connector that is configured to mate with the electrical connector 10. Although one example is specifically illustrated herein, the opening 108 may have any suitable size, shape, geometry, and/or the like for holding the conductor-receiving end portion 23 of the inner electrical contact 20.

Figure 5:
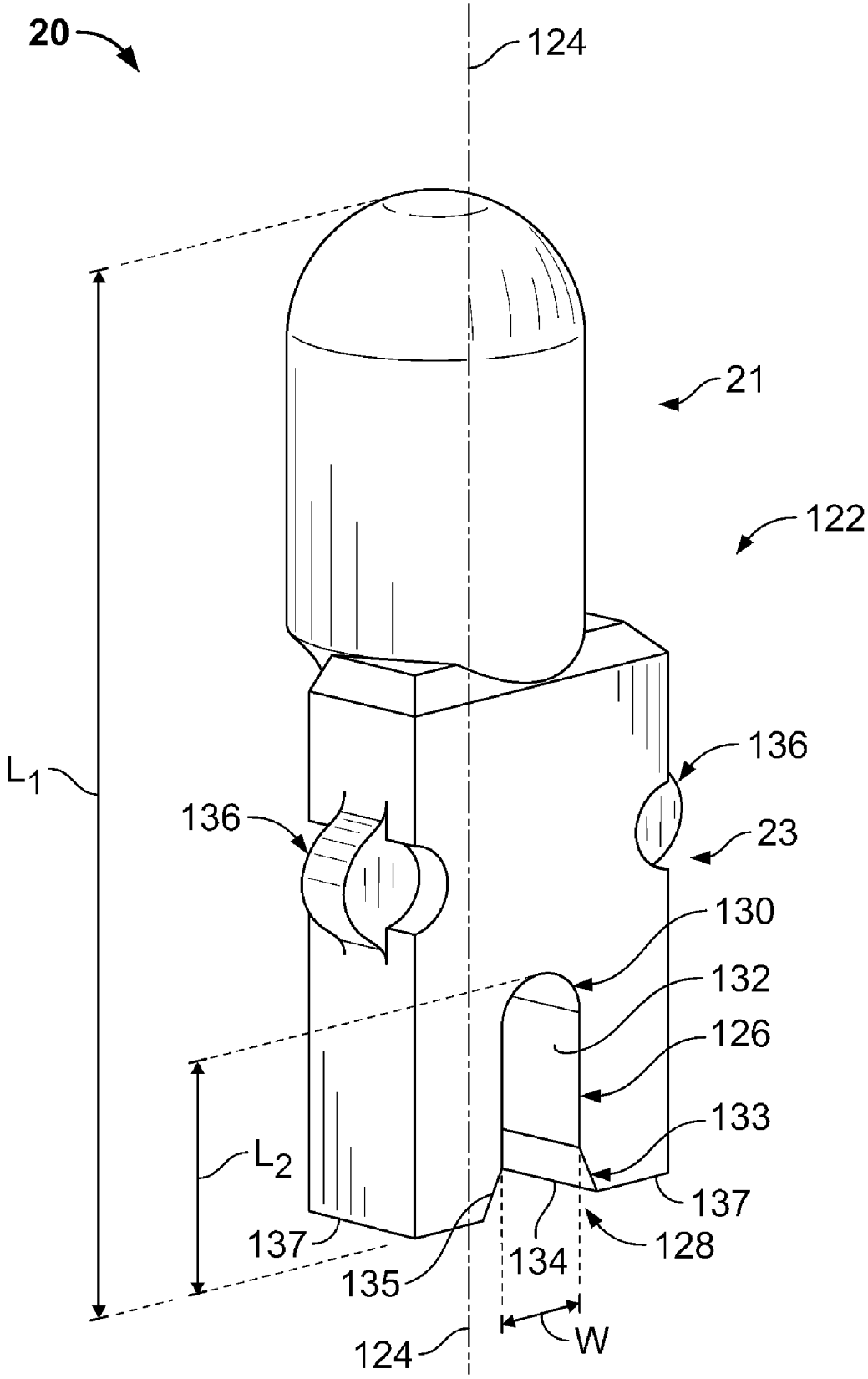
FIG. 5 is a perspective view of an exemplary embodiment of an inner electrical contact of the electrical connector shown in FIGS. 1 and 2.

FIG. 5 is a perspective view of an exemplary embodiment of the inner electrical contact 20 of the electrical connector 10 (FIGS. 1, 2, and 6). The inner electrical contact 20 includes a body 122 extending a length $L_1$ along a central longitudinal axis 124 and between the plug contact end portion 21 and the conductor-receiving end portion 23. The body 122 may optionally be integrally formed such that the plug contact end portion 21 and the conductor-receiving end portion 23 are integrally formed. The conductor-receiving end portion 23 includes a slot 126 extending therein. As described below, the slot 126 receives the inner electrical conductor 24 (FIGS. 1, 2, 6-9) of the coaxial cable 14 therein to electrically connect the inner electrical conductor 24 to the inner electrical contact 20. The slot 126 extends a length $L_2$ along the central longitudinal axis 124 between an open end portion 128 and an opposite end portion 130. The length $L_2$ may be referred to herein as a "slot length". The slot 126 includes a pair of opposing side walls 132 and 134 that define a width W of the slot 126. The width W is smaller than a diameter DIA (FIG. 2) of the inner electrical conductor 24 of the coaxial cable 14 such that the inner electrical conductor 24 is compressed between the side walls 132 and 134, as described below and illustrated in FIG. 6. Respective intersections 133 and 135 between the side walls 132 and 134 and a surface 137 of the conductor-receiving end portion 23 of the body 122 may optionally be chamfered to facilitate reception of the inner electrical conductor 24 into the slot 126 during termination of the inner electrical conductor 24 of the coaxial cable 14 by the inner electrical contact 20.

The body 122 of the inner electrical contact 20 may optionally include one or more retention barbs 136 that extend outwardly for reception within an indentation 138 (FIG. 6) within a corresponding wall 140 and 142 (FIG. 6) that defines the opening 108 (FIGS. 3, 4, and 6-9) of the insulating member 18 (FIGS. 1-4 and 6-9), as described below and illustrated in FIG. 6. In the exemplary embodiment, the body 122 includes a pair of opposite retention barbs 136 that are each received within a corresponding indentation 138. However, the body 122 may include any number of retention barbs 136 for reception within any number of indentations 138. Although one example is specifically illustrated herein, the retention barbs 136 and the indentations 138 may each have any suitable size, shape, geometry, and/or like that allow the retention barbs 136 to be at least partially received within the indentations 138.

Although one example is specifically illustrated herein, the slot 126 may have any suitable size, shape, geometry, and/or the like for holding the inner electrical conductor 24 therein. Similarly, although one example is specifically shown, the plug contact end portion 21 and the conductor-receiving end portion 23 may each have any suitable size, shape, geometry, and/or the like for being received within the receptacle contact of another electrical connector and the opening 108, respectively.

Referring now to FIGS. 2 and 6, the conductor-receiving end portion 23 of the inner electrical contact 20 is held within the opening 108 of the insulating member 18. The slot 126 of the inner electrical contact 20 holds the inner electrical conductor 24 of the coaxial cable therein such that the inner electrical conductor 24 engages the side walls 132 and 134 of the slot 126. The inner electrical conductor 24 is thereby electrically connected to the inner electrical contact 20. As described above, the diameter DIA of the inner electrical conductor 24 is compressed between the side walls 132 and 134 to facilitate mechanical and electrical connection between the inner electrical conductor 24 and the inner electrical contact 20. As can be seen in both FIGS. 2 and 6, the surface 137 of the conductor-receiving end portion 23 engages the bottom surface 112 of the opening 108 of the insulating member 18 on both sides of the slot 126. As shown in FIG. 6, the retention barbs 136 are each received in the corresponding indentation 138 of the walls 140 and 142 to facilitate holding the inner electrical contact 20 within the opening 108 of the insulating member 18.

Figure 8:
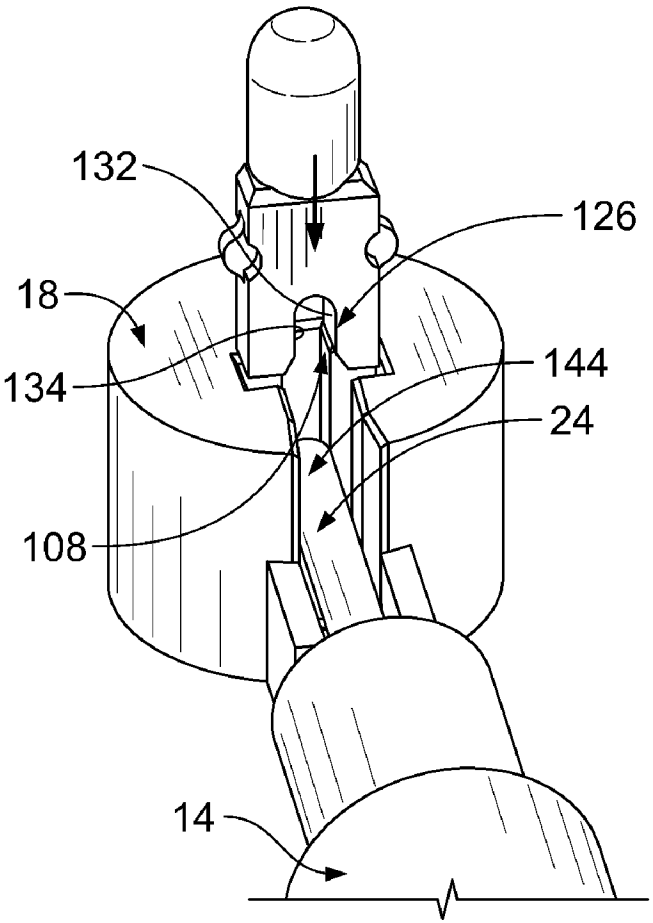
FIGS. 7-9 are perspective views of a portion of the electrical connector and coaxial cable shown in FIGS. 1, 2, and 6 illustrating termination of an inner electrical conductor of the coaxial cable by the inner electrical contact shown in FIG. 5.
Figure 7:
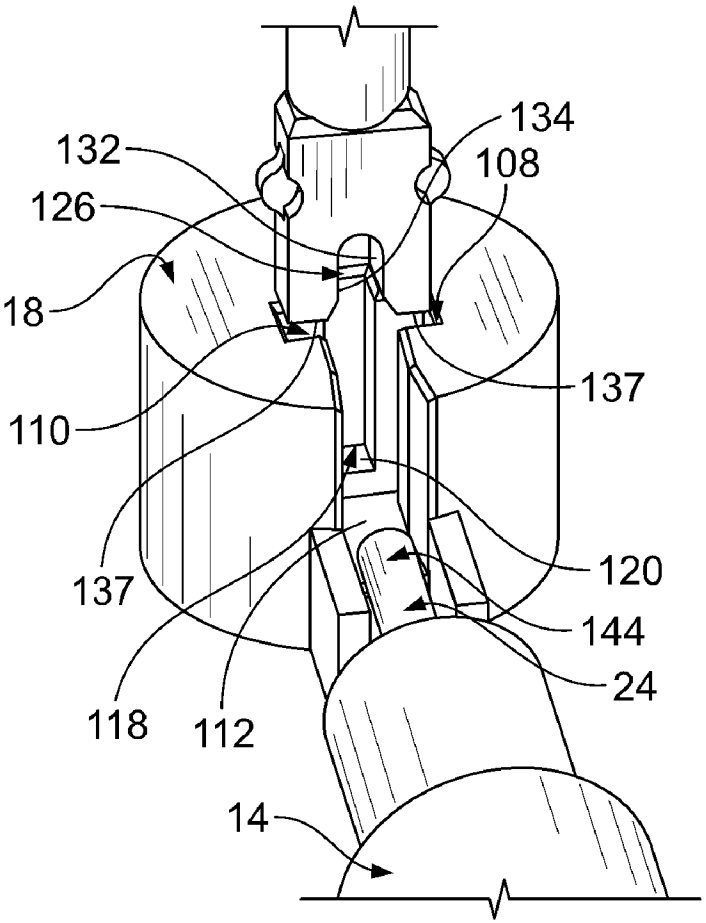
Figure 9:
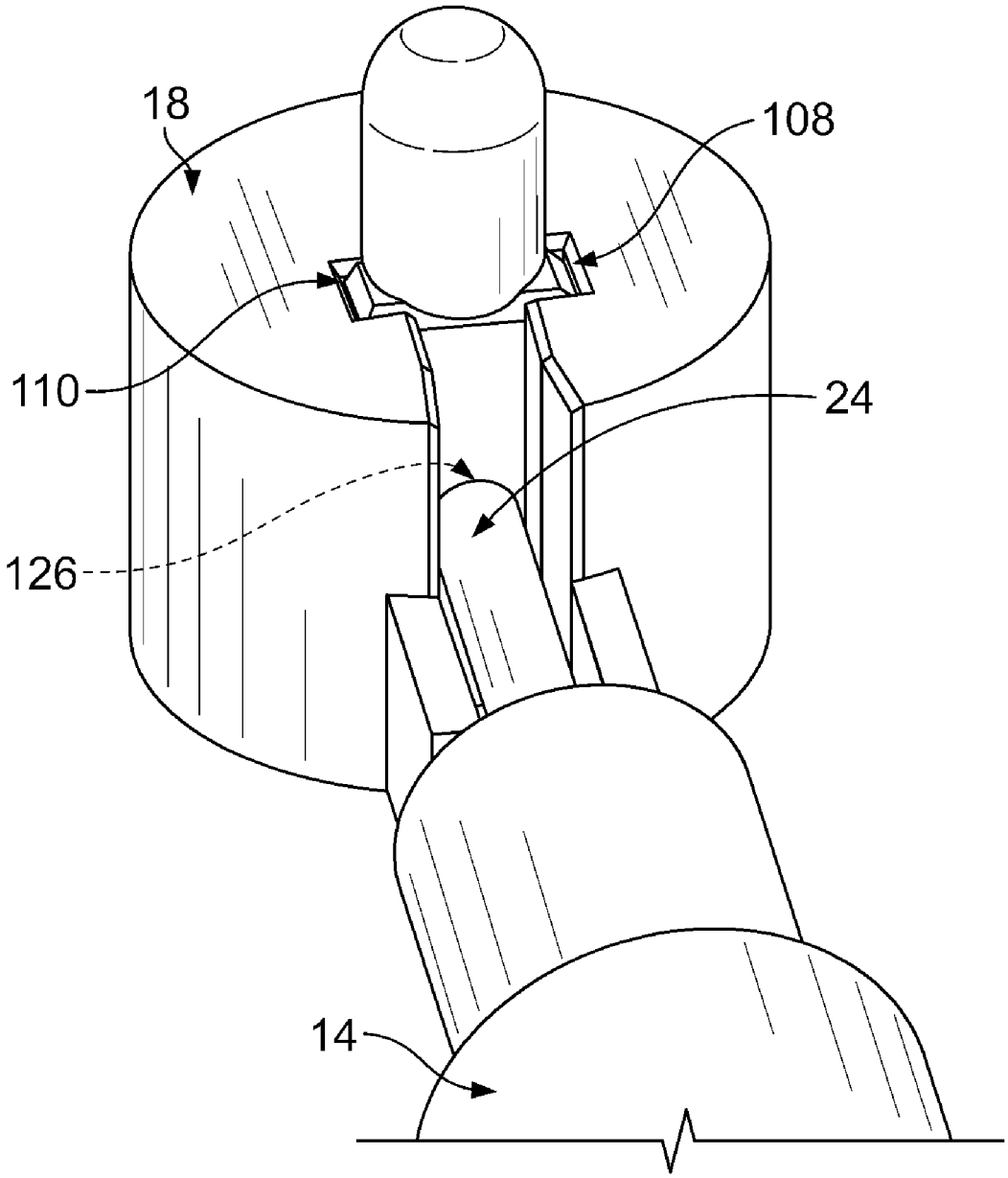

Referring now to FIGS. 7-9, to terminate the inner electrical conductor 24 of the coaxial cable 14, the inner electrical conductor 24 is inserted into the opening 108 of the insulating member 18 such that an end portion 144 of the inner electrical conductor 24 rests on the surface 120 of the ledge 118. The inner electrical contact 20 is inserted into the opening 108 such that the inner electrical conductor 24 is forced into the slot 126. Because the surface 120 of the ledge 118 is shallower relative to the open end 110 of the opening 108 than the bottom surface 112 against which the surface 137 of the inner electrical contact 20 is engaged, movement of the inner electrical contact 20 into the slot until the surface 137 engages the bottom surface 112 forces the inner electrical conductor 24 into the position between the side walls 132 and 134 of the slot 126 that is shown in FIGS. 6 and 9. The inner electrical conductor 24 may be terminated by the inner electrical contact 20 as shown in FIGS. 7-9 before, during, or after that insulating member 18 is installed within the receptacle 48 (FIGS. 1 and 2) of the outer electrical contact 22 (FIGS. 1, 2, and 6).

Figure 10:
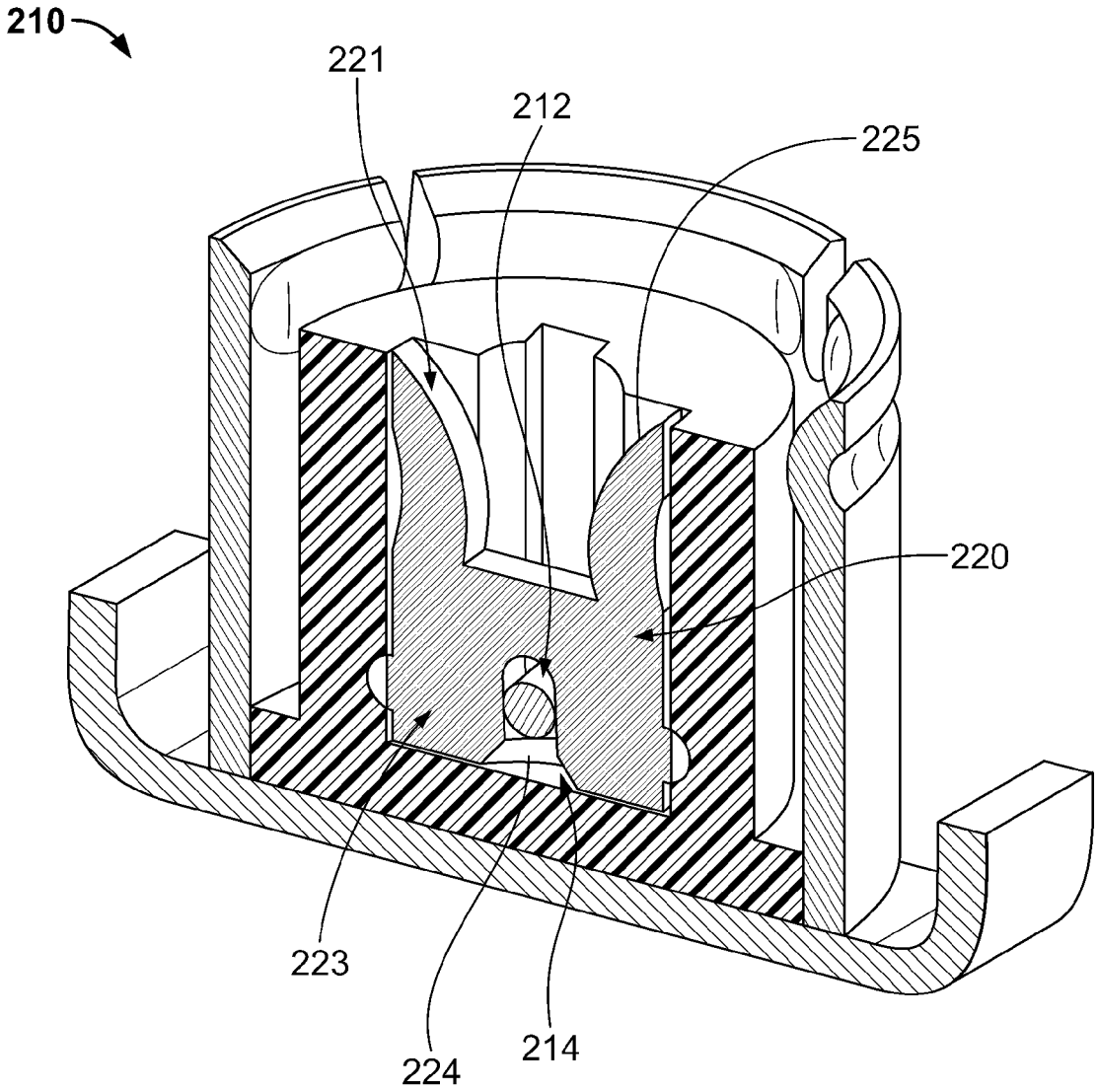
FIG. 10 is a cross sectional view of an exemplary alternative embodiment of an electrical connector terminating the end of a coaxial cable illustrating an exemplary alternative embodiment of an inner electrical contact.

Although the inner electrical contact 20 is described and illustrated above as a plug contact that is received by a receptacle contact (not shown) of another electrical connector (not shown), the inner electrical contact 20 may alternatively be a receptacle contact that is configured to receive a plug contact of another electrical connector. For example, FIG. 10 is a cross sectional view of an exemplary alternative embodiment of an electrical connector 210 terminating the end 212 of a coaxial cable 214 illustrating an exemplary alternative embodiment of an inner electrical contact 220. The inner electrical contact 220 extends between a receptacle contact end portion 221 and a conductor-receiving end portion 223. The receptacle contact end portion 221 may be referred to herein as a "contact end portion". The conductor-receiving end portion 223 is engaged with, and thereby electrically connected to, an inner electrical conductor 224 of a coaxial cable 214 in a substantially identical manner as that described and illustrated herein with respect to the inner electrical contact 20 (FIGS. 1, 2, and 5-9). The receptacle contact end portion 221 includes an opening 225 configured to receive a plug contact end portion (such as, but not limited to, the plug contact end portion 21 shown in FIGS. 1, 2, and 5-9) of an inner electrical contact (such as, but not limited to, the inner electrical contact 20) of another electrical connector (such as, but not limited to, the electrical connector 10 shown in FIGS. 1, 2, and 6) such that the inner electrical contact 220 is engaged with, and thereby electrically connected to, the inner electrical contact of the other electrical connector.

Figure 11:
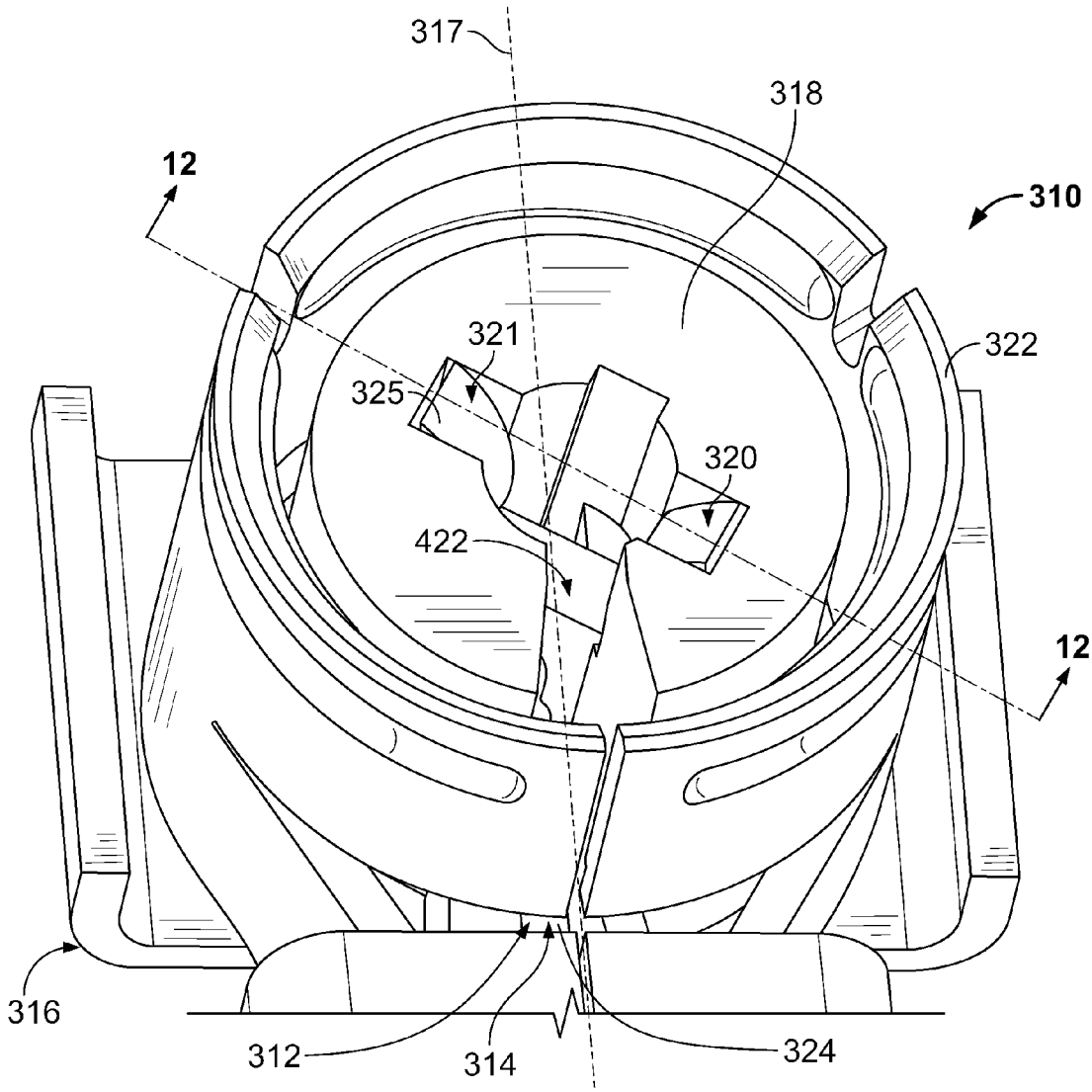
FIG. 11 is a perspective view of a portion of an exemplary alternative embodiment of an electrical connector terminating the end of a coaxial cable illustrating an exemplary alternative embodiment of an inner electrical contact.
Figure 12:
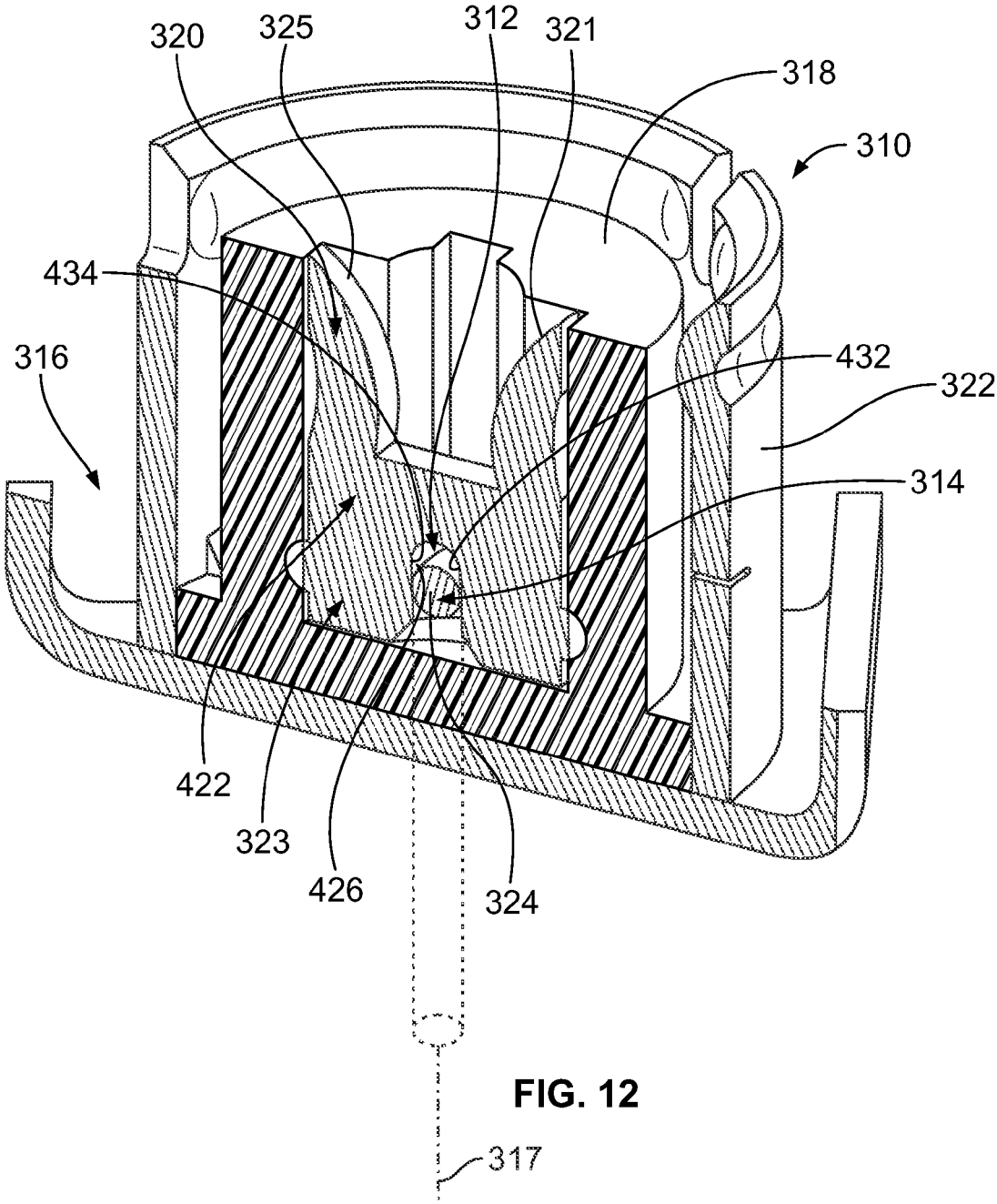
FIG. 12 is a cross-section of the electrical connector and coaxial cable shown in FIG. 11 taken along line 12-12 of FIG. 11.

FIG. 11 is a perspective view of a portion of an exemplary alternative embodiment of an electrical connector 310 terminating the end 312 of a coaxial cable 314 illustrating an exemplary alternative embodiment of an inner electrical contact 320. FIG. 12 is a cross-section of the electrical connector 310 and coaxial cable 314 taken along line 12-12 of FIG. 11. The electrical connector 310 includes an electrically conductive housing 316 that extends a length along a central longitudinal axis 317, an insulating member 318 held by the housing 316, and an inner electrical contact 320 held by the insulating member 318. In the exemplary embodiment, the inner electrical contact 320 is a receptacle contact. Alternatively, the inner electrical contact is a plug contact, which is sometimes referred to as a "pin contact". The housing 316 includes an outer electrical contact 322 that holds the insulating member 318. The electrical connector 310 may be any type of connector suitable for use with any type of coaxial cable; such connectors are sometimes referred to as "coaxial cable connectors". In the exemplary embodiment, the electrical connector 310 is an ultra miniature coax connector (UMCC).

The inner electrical contact 320 extends between a receptacle contact end portion 321 and a conductor-receiving end portion 323. The receptacle contact end portion 321 may be referred to herein as a "contact end portion". The conductor-receiving end portion 323 is engaged with, and thereby electrically connected to, an inner electrical conductor 324 of the coaxial cable 314, as will be described below. The receptacle contact end portion 321 includes an opening 325 configured to receive a plug contact end portion (such as, but not limited to, the plug contact end portion 21 shown in FIGS. 1, 2, and 5-9) of an inner electrical contact (such as, but not limited to, the inner electrical contact 20) of another electrical connector (such as, but not limited to, the electrical connector 10 shown in FIGS. 1, 2, and 6) such that the inner electrical contact 320 is engaged with, and thereby electrically connected to, the inner electrical contact of the other electrical connector.

The inner electrical contact 320 includes a body 422 extending a between the receptacle contact end portion 321 and the conductor-receiving end portion 323. The conductor-receiving end portion 323 includes a slot 426 extending therein. The slot 426 receives the inner electrical conductor 324 of the coaxial cable 314 therein to electrically connect the inner electrical conductor 324 to the inner electrical contact 320. The slot 426 includes a pair of opposing side walls 432 and 434 that define a width of the slot 426. The width W is smaller than a diameter of the inner electrical conductor 324 of the coaxial cable 314 such that the inner electrical conductor 324 is compressed between the side walls 432 and 434, as shown in FIG. 12. The inner electrical contact 320 is rotated relative to the central longitudinal axis 317 such that the side walls 432 and 434 of the slot 426 are oriented non-parallel to the central longitudinal axis 317.

The embodiments described and/or illustrated herein provide a coaxial cable connector that may enable an inner electrical conductor of a coaxial cable to be more easily terminated to the coaxial cable connector as compared with at least some known coaxial cable connectors. For example, the embodiments described and/or illustrated herein provide a coaxial cable connector that may enable an inner electrical conductor of a coaxial cable to be terminated to the coaxial cable connector using generic tools and/or fewer operations as compared with at least some known coaxial cable connectors.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. Other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical connector for terminating a coaxial cable, said electrical connector comprising:

an electrically conductive housing extending a length along a central longitudinal axis between a cable-receiving end portion configured to engage an insulating cover of the coaxial cable and a mating end portion configured to engage another electrical connector, the housing comprising an outer electrical contact, an insulating member held by the housing; and an inner electrical contact held by the insulating member, the inner electrical contact comprising a slot configured to receive an inner electrical conductor of the coaxial cable, the slot being defined by a side surface that is oriented non-parallel to the central longitudinal axis of the housing such that the slot is configured to bend an end of the inner electrical conductor of the coaxial cable when the inner electrical conductor is received within the slot, the slot being configured to bend the end of the inner electrical conductor such that the end of the inner electrical conductor extends non-parallel to the central longitudinal axis.

2. The electrical connector according to claim 1, wherein the slot has a width defined between the side surface and an opposing side surface of the slot, the width being smaller than a diameter of the inner electrical conductor of the coaxial cable such that the inner electrical conductor is compressed between the side surfaces when the inner electrical conductor is received within the slot between the side surfaces.

3. The electrical connector according to claim 1, wherein the insulating member comprises an opening extending between an open end and a bottom surface, the bottom surface extending a first depth from the open end, the opening comprising a ledge extending a second depth from the open end that is less than the first depth of the bottom surface, the ledge being configured to hold an end portion of the inner electrical conductor thereon, a portion of the inner electrical contact being held within the opening and engaging the bottom surface of the opening.

4. The electrical connector according to claim 1, wherein the insulating member comprises an opening and a portion of the inner electrical contact is held within the opening, the inner electrical contact comprising a retention barb that is received within an indentation of a wall of the insulating member that defines the opening.

5. The electrical connector according to claim 1, wherein the inner electrical contact extends a length between a contact end portion configured to engage an electrical contact of the other electrical connector and a conductor-receiving end portion configured to engage the inner electrical conductor of the coaxial cable, the slot extending within the conductor-receiving end portion.

6. The electrical connector according to claim 1, wherein the side surface of the slot is oriented obliquely to the central longitudinal axis of the housing.

7. The electrical connector according to claim 1, wherein the inner electrical contact extends a length between a plug contact end portion and a conductor-receiving end portion, the plug contact end portion configured to be received within a receptacle contact portion of an electrical contact of the other electrical connector.

8. The electrical connector according to claim 1, further comprising the coaxial cable, wherein the cable-receiving end portion of the housing is engaged with the insulating cover of the coaxial cable, and the inner electrical conductor of the coaxial cable is received within the slot.

9. The electrical connector according to claim 1, wherein the slot extends completely through the inner electrical contact along a central axis, the inner electrical contact being rotated relative to the central longitudinal axis of the housing such that the central axis of the slot extends non-parallel to the central longitudinal axis of the housing.

10. An electrical connector comprising:

an insulating member configured to be held by an electrically conductive housing of the electrical connector, the insulating member comprising an opening extending between an open end and a bottom surface; and an inner electrical contact configured to be held by the insulating member, the inner electrical contact comprising a pair of arms having free ends, the inner electrical contact further comprising a slot defined between the arms and configured to receive an inner electrical conductor of a coaxial cable, wherein the inner electrical contact is configured to be loaded into the opening of the insulating member through the open end in a direction toward the bottom surface such that the free ends of the arms of the inner electrical contact engage the bottom surface before the electrical connector is mated with another electrical connector.

11. The electrical connector according to claim 10, wherein the slot has a width defined between a pair of opposing side walls of the slot, the width being smaller than a diameter of the inner electrical conductor of the coaxial cable such that the inner electrical conductor is compressed between the side walls when the inner electrical conductor is received within the slot between the side walls.

12. The electrical connector according to claim 10, wherein the bottom surface extends a first depth from the open end, the opening comprising a ledge extending a second depth from the open end that is less than the first depth of the bottom surface, the ledge being configured to hold an end portion of the inner electrical conductor thereon.

13. The electrical connector according to claim 10, wherein the inner electrical contact comprises a retention barb that is configured to be received within an indentation of a wall of the insulating member that defines the opening.

14. The electrical connector according to claim 10, wherein the inner electrical contact extends a length between a contact end portion configured to engage an electrical contact of another electrical connector and a conductor-receiving end portion configured to engage the inner electrical conductor of the coaxial cable, the slot extending within the conductor-receiving end portion.

15. The electrical connector according to claim 10, wherein the inner electrical conductor of the coaxial cable extends a length along a central longitudinal axis, the slot having a slot length that is configured to extend approximately perpendicular to the central longitudinal axis of the inner electrical conductor when the inner electrical conductor is received within the slot.

16. The electrical connector according to claim 10, wherein the inner electrical contact extends a length between a plug contact end portion and a conductor-receiving end portion, the plug contact end portion configured to be received within a receptacle contact portion of an electrical contact of another electrical connector.

17. The electrical connector according to claim 10, further comprising the housing of the electrical connector, the housing extending a length between a cable-receiving end portion configured to engage an insulating cover of the coaxial cable and a mating end portion configured to engage another electrical connector, the housing comprising an outer electrical contact.

18. An electrical connector comprising:

a coaxial cable comprising an inner electrical conductor and an insulating layer surrounding the inner electrical conductor;

an insulating member configured to be held by an electrically conductive housing of the electrical connector, the insulating member comprising an opening extending between an open end and a bottom surface;

an inner electrical contact configured to be held by the insulating member, the inner electrical contact comprising a slot configured to receive the inner electrical conductor of the coaxial cable, wherein the inner electrical contact is configured to be loaded into the opening of the insulating member through the open end in a direction toward the bottom surface such that the inner electrical contact engages the bottom surface, and wherein the inner electrical conductor extends outwardly from an end portion of the insulating layer into the opening of the insulating member for reception within the slot of the inner electrical contact.

* * * * *